US006963058B2

(12) United States Patent
Head et al.

(10) Patent No.: US 6,963,058 B2
(45) Date of Patent: Nov. 8, 2005

(54) MICROWAVE OVEN SYSTEMS AND METHODS

(75) Inventors: Jesse S. Head, Louisville, KY (US); Brigid Blocker, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/458,585

(22) Filed: Jun. 10, 2003

(65) Prior Publication Data

US 2004/0251249 A1 Dec. 16, 2004

(51) Int. Cl.[7] ..... H05B 6/68
(52) U.S. Cl. ..... 219/682; 219/707
(58) Field of Search ..... 219/682, 707, 219/705, 703, 704, 715, 716, 718, 719, 492, 518, 448.12; 99/333, 325

(56) References Cited

U.S. PATENT DOCUMENTS 4,093,841 A 6/1978 Dills
4,130,749 A 12/1978 Tanaka et al.
4,133,998 A 1/1979 Otani
4,506,127 A * 3/1985 Satoh ..... 219/710
4,626,662 A 12/1986 Woolf
4,791,263 A 12/1988 Groeschel, Jr.
5,889,264 A * 3/1999 Kidblad et al. ..... 219/707
6,501,058 B2 12/2002 Jung
6,642,491 B1 * 11/2003 Torngren et al. ..... 219/705

* cited by examiner

*Primary Examiner*—Quang T. Van
(74) *Attorney, Agent, or Firm*—H. Neil Houser, Esq.; Armstrong Teasdale LLP

(57) ABSTRACT

A simmering method includes energizing a generator of an oven to raise humidity inside a chamber of the oven to a first level, and performing a simmering operation for a first predetermined amount of time after the humidity reaches the first level, the simmering operation including deenergizing the generator, and energizing the generator after the deenergizing of the generator.

20 Claims, 5 Drawing Sheets

MICROWAVE OVEN SYSTEMS AND METHODS

BACKGROUND OF THE INVENTION

This invention relates generally to cooking and more particularly, to microwave oven systems and methods for simmering.

Microwave ovens have become widely accepted in many countries for cooking of many foods at a fast cooking rate. The microwave frequency energy is radiated within an oven cooking cavity from an energy source such as a magnetron. The waves are radiated and reflected within the oven cavity and are distributed, for example, by mode stirrers, antennas, and the like. The microwave energy sets up a high-frequency oscillatory movement of the molecules in the food to cause internal heating by molecular friction.

While microwave oven cooking is a fast growing segment of the cooking industry, some people may be reluctant to purchase a microwave oven because they feel no need to cook faster and, furthermore, may attribute slow cooking or simmering with high quality end results regarding nutrition, tenderness, flavor, economy, and convenience, even with cheaper cuts of meat. Also, at least some believe that there is little routine main course meal preparation with microwave ovens, and that microwave oven owners tend to use the ovens in limited ways.

BRIEF DESCRIPTION OF THE INVENTION

In one aspect, a simmering method is provided. The simmering method includes energizing a generator of an oven to raise humidity inside a chamber of the oven to a first level, and performing a simmering operation for a first predetermined amount of time after the humidity reaches the first level, the simmering operation including deenergizing the generator, and energizing the generator after the deenergizing of the generator.

In another aspect, a controller is provided. The controller is programmed to energize a generator of an oven to raise humidity inside a chamber of the oven to a first level, and perform a simmering operation for a first predetermined amount of time after the humidity reaches the first level, the simmering operation including deenergizing the generator, and energizing the generator after the deenergizing of the generator.

In yet another aspect, an oven is provided. The oven includes a generator for providing energy to an item placed inside the oven, a sensor for sensing an amount of humidity produced by the item inside the oven, and a controller for performing a simmering operation on the item. The controller is configured to energize the generator to raise humidity inside the oven to a first level, and perform a simmering operation for a first predetermined amount of time after the humidity reaches the first level. The simmering operation includes deenergizing the generator, and energizing the generator after the deenergizing of the generator.

DETAILED DESCRIPTION OF THE INVENTION

Figure 1:
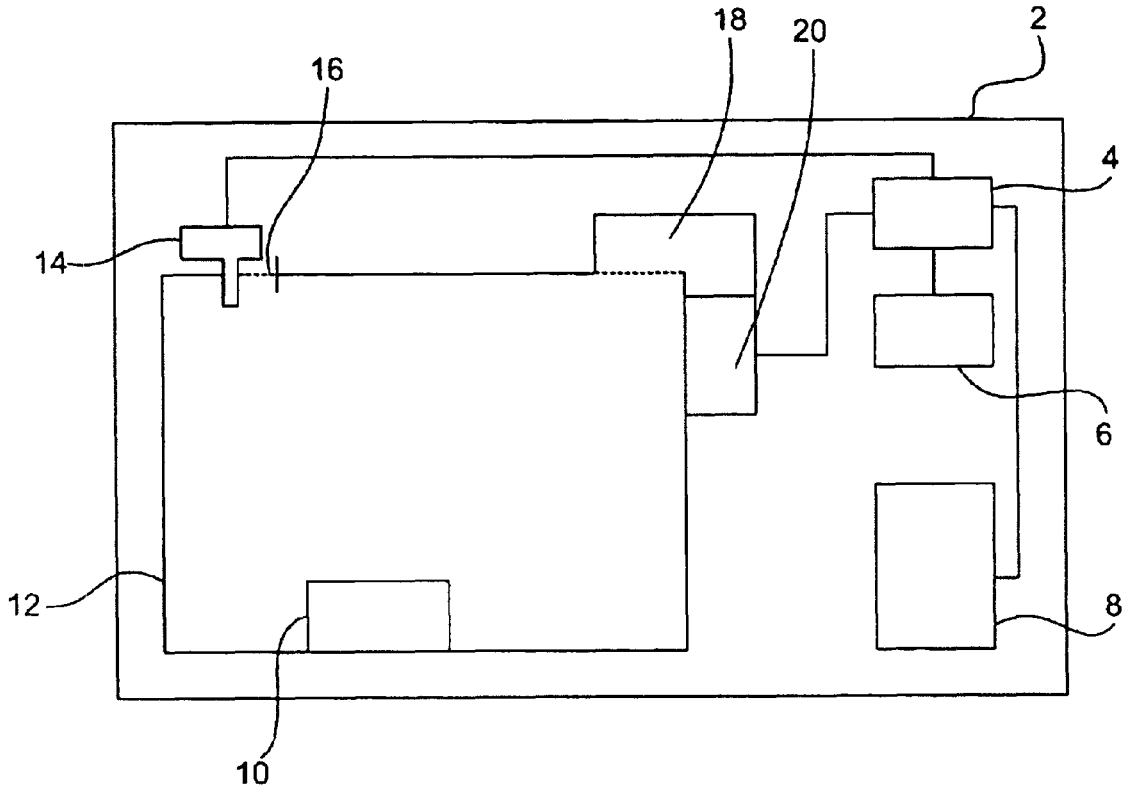
FIG. 1 illustrates an embodiment of a microwave oven having a simmering system to simmer an item.

FIG. 1 illustrates an embodiment of a microwave oven 2 having a simmering system to simmer an item 10, such as, food or water. Size of item 10 ranges from a weight of 0.5 pounds (lbs.) to 6.5 lbs. or from a weight of 8 ounces (oz.) to 104 oz. As an example, item 10 is a 6.5 lb. stew. As another example, item 10 is a 16 oz. bowl of green beans. Microwave oven 2 includes a controller 4, a display 6, a keypad 8, a chamber 12, a sensor 14, a vent 16, a guide 18, and a generator 20 that generates microwaves. It is noted that in an alternative embodiment, any oven having a generator of microwaves, such as, a speedcooking oven, can be used instead of microwave oven 2. The term controller is not limited to just those integrated circuits referred to in the art as controllers, but broadly refers to controllers, processors, microcontrollers, microcomputers, programmable logic controllers, application specific integrated circuits, and other programmable circuits, and these terms are used interchangeably herein. Examples of displays include a light emitting diode (LED) display and a vacuum fluorescent display (VFD). An example of generator 20 includes a magnetron that generates microwaves. Controller 4 is coupled to display 6, keypad 8, sensor 14, and generator 20.

A user places item 10 inside chamber 12 for simmering item 10. The user uses keypad 8 to operate microwave oven 2. Keypad 8 provides various options to the user to simmer item 10. As one example, the user uses keypad 8 to enter an amount of time for which the user desires to simmer item 10. As another example, the user uses keypad 8 to enter a power level at which the user desires to simmer item 10. As yet another example, the user uses keypad 8 to enter the type of item 10 that the user desires to simmer. Display 6 shows the user one or all of the various options that the user selects using keypad 8. As an example, display 6 shows the time for which the user desires to simmer item 10 and a countdown of the time as item 10 is being simmered. As another example, display 6 shows the power level at which the microwave oven 2 operates. As yet another example, display 6 shows whether item 10 is being simmered, cooked, boiled, or baked.

During operation of microwave oven 2, generator 20 generates microwaves which are delivered to chamber 12 via guide 18. A cooling fan (not shown) cools generator 20. Item 10 is heated by energy of the microwaves which cause moisture to leave item 10 into the air within chamber 12. Sensor 14 provides a signal, such as a voltage signal or a current signal, to controller 4. The signal corresponds to a level of humidity inside chamber 12, which is measured when moisture content of air inside chamber 12 is being exhausted via vent 16. Controller 4 receives the signal from sensor 14 and controls power level of generator 20 during operation of microwave oven 2.

Figure 2:
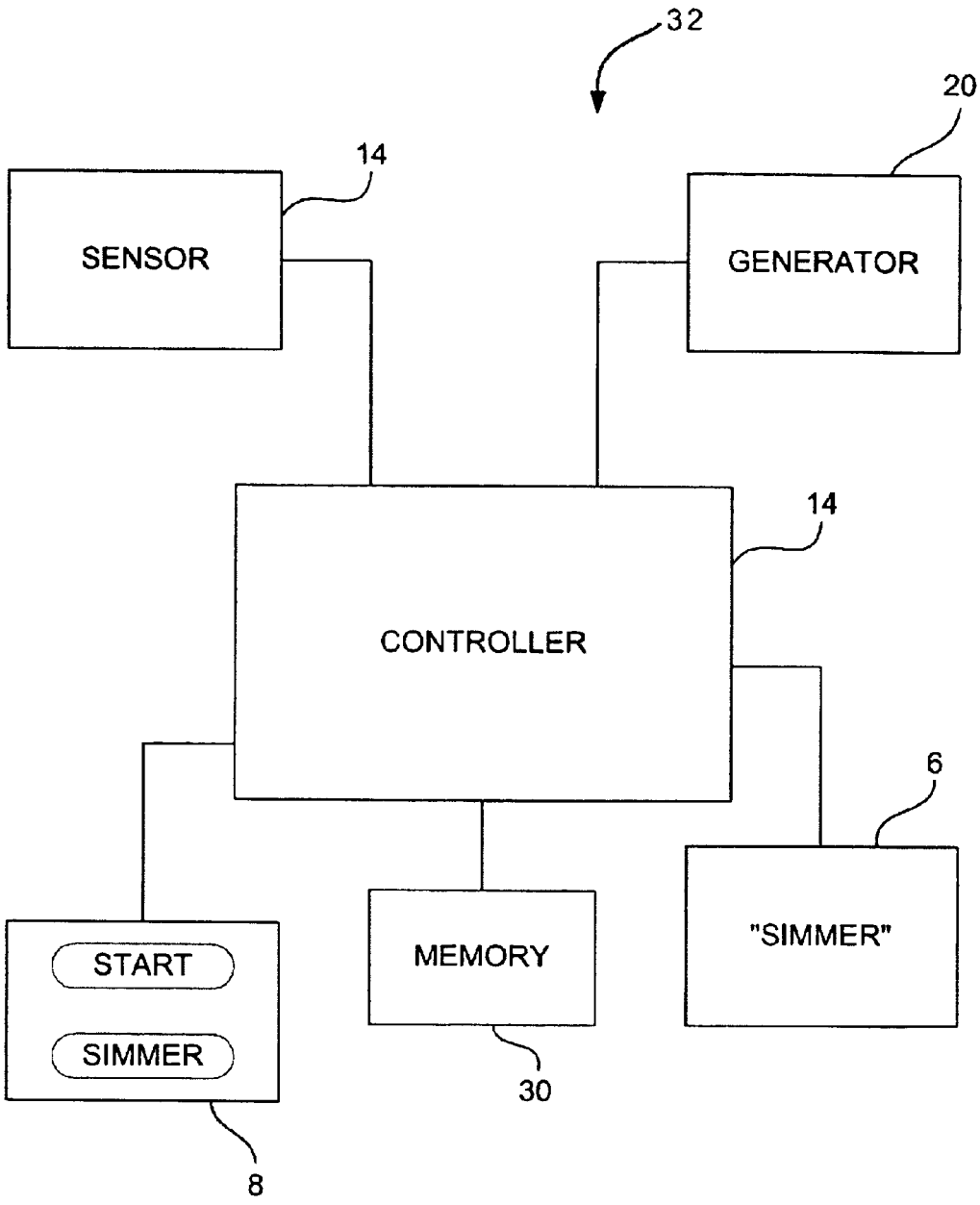
FIG. 2 is a schematic view of a simmering system for simmering the item.

FIG. 2 is a schematic view of a simmering system 32 for simmering item 10. Simmering system 32 includes controller 4, display 6, keypad 8, and sensor 14, generator 20, and a memory 30. Keypad 8 has a "SIMMER" button and a "START" button. Examples of memory 30 include a random access memory (RAM), a flash memory (FLASH), a programmable read only memory (PROM), and an electronically erasable programmable read only memory (EEPROM). Memory 30 is coupled to controller 4.

Figure 3:
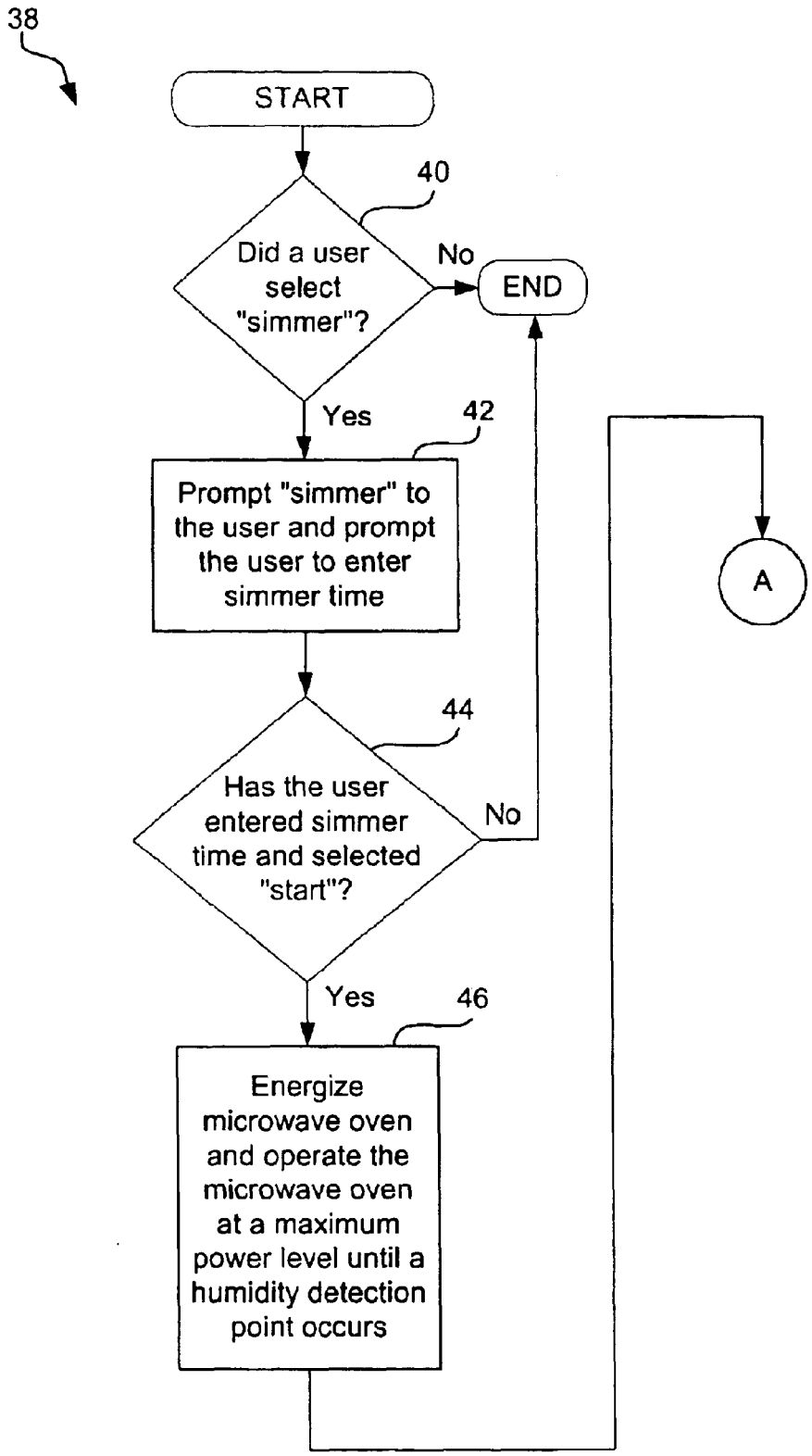
FIGS. 3 and 4 illustrate a flowchart of a simmering method that is executed by the simmering system of FIG. 2.
Figure 4:
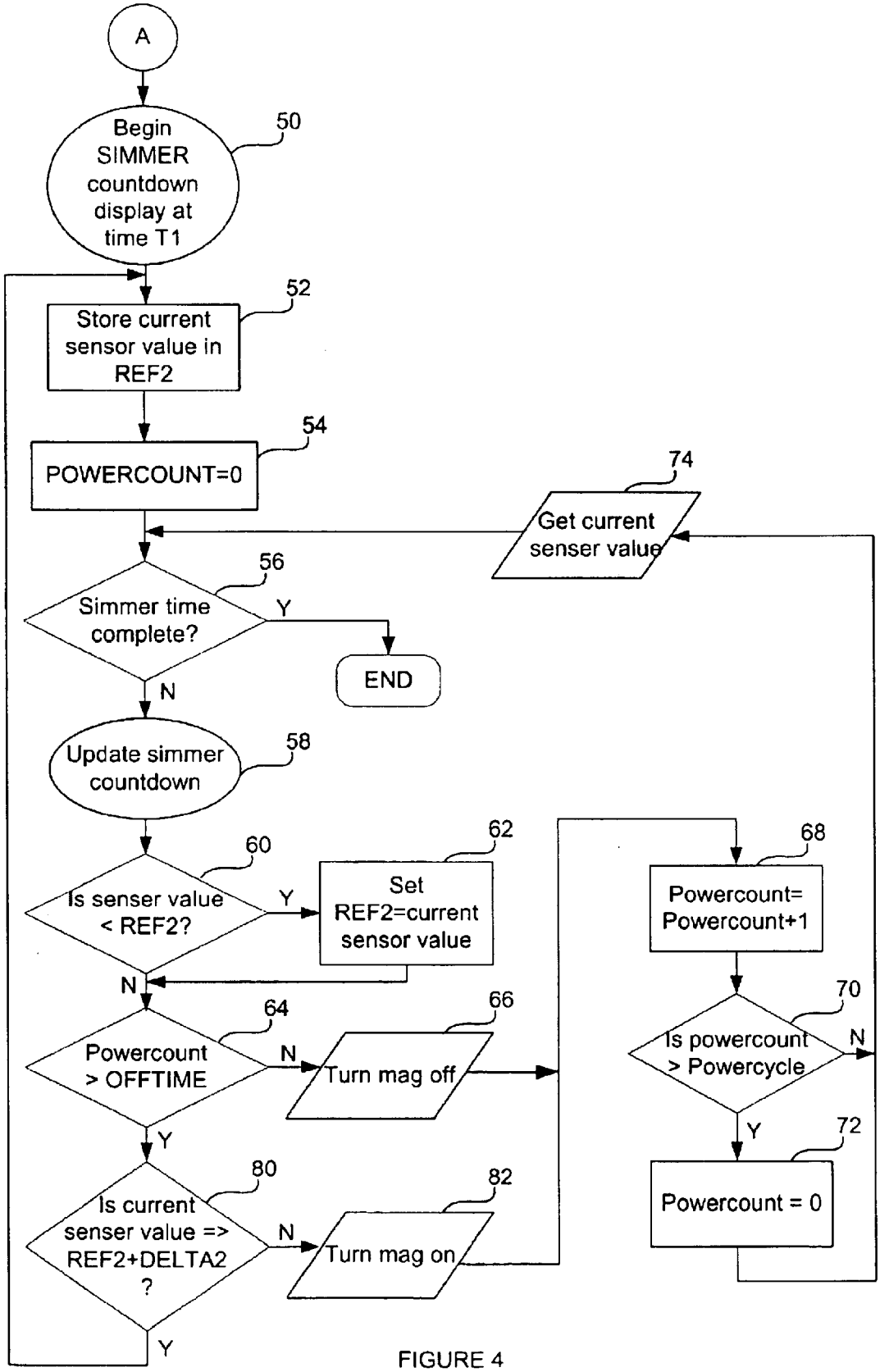

FIGS. 3 and 4 illustrate a flowchart of a simmering method 38 that is executed by simmering system 32 (FIG. 2). Method 38 includes determining 40 whether a user has pressed "SIMMER" button on keypad 8. When the "SIMMER" button is pressed, method 38 includes providing 42 "SIMMER" on display 6 to prompt the user to enter a simmer time. For example, display 6 scrolls "ENTER SIMMER TIME". As another example, display 6 shows "ENTER SIMMER TIME" to the user. The user enters simmer time, which, in one embodiment, ranges between 0 and 120 minutes. As an example, the user enters a simmer time of 10 minutes for a 16 oz. bowl of green beans or fresh vegetables. As another example, the user enters a simmer time of 115 minutes for a 6.5 lb. stew.

Method 38 includes determining 44 whether the user has entered the simmer time and pressed a "START" button on keypad 8. On determining 44 that the user has entered the simmer time and pressed the "START" button on keypad 8, method 38 includes energizing 46 generator 20 and operating generator 20 at its maximum power level to heat item 10 until time T1 that corresponds to a particular humidity level inside chamber 12, which is being continuously measured by sensor 14. For example, the user selects a simmer time and maximum power is applied until sensor 14 senses a predetermined humidity level indicative of a boiling condition or an imminent boiling condition. Alternatively, T1 is determined by calculating the first derivative of the humidity curve and a positive derivative above a predetermined threshold that indicates a sudden influx of moisture. An example of maximum power level includes a power level of 10 in a microwave oven having power levels ranging from 1 thru 10. Another example of maximum power level includes a power level of 800 watts in a microwave oven having power levels ranging from 80 thru 800 watts. Yet another example of maximum power level includes a power level of 800 watts in a microwave oven having power levels ranging from 10% to 100%.

Method 38 includes beginning 50 at time T1, a countdown of the simmer time that the user had entered. The beginning of the countdown of the simmer time is a start of a simmering operation. Method 38 also includes obtaining 52 from sensor 14, a voltage representative of a level of humidity in chamber 12, and storing the voltage in memory 30 as REF2. During simmering method 38, sensor 14 measures the level of humidity inside chamber 12, converts the level into a voltage, and the voltage is received by controller 4. Method 38 includes initiating 54 a counter (not shown) to count from 0 seconds. The counter is coupled to controller 4 and the count of the counter is referred to as POWERCOUNT. Alternatively, the counter may be located inside controller 4. Method 38 also includes determining 56 whether the simmer time has ended. If the simmer time has ended, simmering method 38 ends. Alternatively, if the simmer time has not ended, method 38 includes updating 58 display 6 to show the countdown of the simmer time. Method 38 also includes determining 60 whether a voltage measured by sensor 14 is less than REF2. On determining 60 that the voltage obtained from sensor 14 is less than REF2, method 38 includes updating 62 REF2 to the voltage measured by sensor 14. Alternatively, on determining 60 that the voltage obtained from sensor 14 is not less than REF2, method 38 includes determining 64 whether the POWERCOUNT is greater than OFFTIME. OFFTIME is an amount of time for which generator 20 of microwave oven 2 is not energized during a POWERCYCLE of the simmering operation. POWERCYCLE is a sum of OFFTIME and ONTIME, which is a maximum amount of time for which generator 20 is energized during the POWERCYCLE. As an example, the simmering operation has a POWERCYCLE of 90 seconds, and the POWERCYCLE has an ONTIME of 60 seconds and an OFFTIME of 30 seconds.

On determining 64 that the POWERCOUNT is not greater than the OFFTIME, method 38 includes deenergizing 66 generator 20. Method 38 also includes incrementing 68 the POWERCOUNT by 1 second and determining 70 whether the POWERCOUNT is greater than the POWERCYCLE. On determining 70 that the POWERCOUNT is greater than the POWERCYCLE, method 38 includes resetting 72 the POWERCOUNT to 0. Method 38 also includes obtaining 74 a voltage from sensor 14 and determining 56 whether the simmer time has ended. Alternatively, on determining 70 that the POWERCOUNT is not greater than the POWERCYCLE, method 38 includes obtaining 74 a voltage from sensor 14 and determining 56 whether the simmer time has ended.

On determining 64 that the POWERCOUNT is greater than the OFFTIME, method 38 includes determining 80 whether the voltage obtained from sensor 14 is at least equal to a sum of REF2 and an offset DELTA2. DELTA2 is an offset of voltage that is measured by sensor 14. The offset allows a sine-shaped humidity signature to occur during the simmering operation. An example of DELTA2 is 0.1 volts. On determining 80 that the voltage obtained from sensor 14 is not at least equal to a sum of REF2 and DELTA2, method 38 includes energizing 82 generator 20 and incrementing 68 the POWERCOUNT by 1 second. Alternatively, on determining 80 that the voltage obtained from sensor 14 is at least equal to a sum of REF2 and DELTA2, method 38 includes obtaining 52 from sensor 14, a voltage corresponding to a level of humidity in chamber 12, and storing the voltage in memory 30 as REF2.

Figure 5:
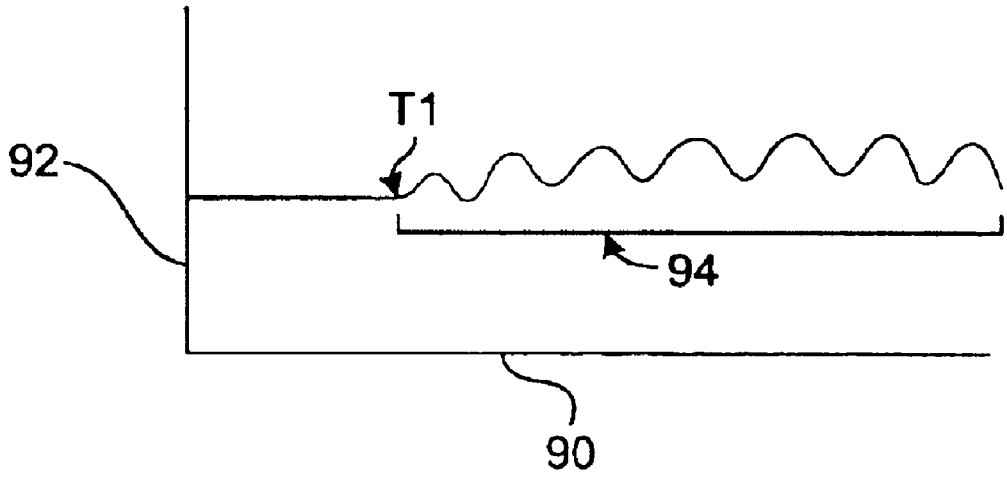
FIG. 5 is a graph illustrating an embodiment of a simmering method.

FIG. 5 is a graph illustrating an embodiment of a simmering method. Plotted along an abscissa 90 is time and along an ordinate 92 is voltage that is obtained from sensor 14. The voltage corresponds to a level of humidity inside chamber 12. During simmering method 38, at time T1, a cyclical simmering operation begins. The simmering operation is shown by portion 94. The simmering operation is not an open-loop cycle. Controller 4 continuously monitors sensor 14 during simmering method 38 and a lowest voltage found after each detection during simmering method 38 is stored as REF2. The lowest voltage represents a lowest humidity level inside chamber 12. Since item 10 is relatively hot immediately after T1, ONTIME during each POWERCYCLE will drive humidity inside chamber 12 higher. The sharp rise in humidity is monitored and whenever it rises above the lowest value measured plus DELTA2, generator 20 is deenergized and OFFTIME of the POWERCYCLE begins. Moreover, if humidity inside chamber 12 overshoots, ONTIME will not restart until the humidity drops below a previously detected value. After a few POWERCYCLES, item 10 will reach near boiling temperatures and during each POWERCYCLE, a short boiling cycle is observed. When generator 20 is deenergized during the simmering operation, any boiling stops immediately and humidity quickly decreases since there is no energy that is stored in generator 20. The ONTIME reduces to 10–15 percent of the POWERCYCLE for small loads, such as, less than 1 pint, and the ONTIME reduces to 20–30 percent of the POWERCYCLE for very large loads, such as greater than 3 quarts.

The herein described simmering systems and methods help provide flavor, texture, and consistency to item 10 and help cook item 10 thoroughly. Also the herein described simmering systems and methods provide these benefits regardless of whether item 10 is small or large.

While the invention has been described in terms of various specific embodiments, those skilled in the art will recognize that the invention can be practiced with modification within the spirit and scope of the claims.

What is claimed is:

1. A simmering method comprising:

energizing a generator of an oven to raise humidity inside a chamber of the oven to a first level; and performing a simmering operation for a first predetermined amount of time after the humidity reaches the first level, the simmering operation including energizing the generator after deenergizing the generator according to a predetermined powercycle, wherein said deenergizing the generator includes deenergizing the generator when a second level of the humidity is at least equal to a lowest level of the humidity measured during the simmering operation.

2. A simmering method comprising:

energizing a generator of an oven to raise humidity inside a chamber of the oven to a first level; and performing a simmering operation for a first predetermined amount of time after the humidity reaches the first level, the simmering operation including:

deenergizing the generator;

energizing the generator after the deenergizing of the generator; and determining whether a first voltage corresponding to a humidity inside the chamber is at least equal to a sum of a second previously stored voltage corresponding to a humidity inside the chamber and a variance of the first voltage.

3. A simmering method in accordance with claim 2 wherein the deenergizing comprises:

deenergizing the generator when the first voltage is at least equal to the sum of the second previously stored voltage and the variance of the first voltage; and deenergizing the generator at an end of each cycle of a second amount of time that is less than the first predetermined amount of time.

4. A simmering method in accordance with claim 3 wherein the simmering operation comprises determining whether the generator is deenergized for a third amount of time that is less than the second amount of time.

5. A simmering method in accordance with claim 4 wherein the energizing the generator after the deenergizing comprises energizing the generator if the generator is deenergized for the third amount of time and the first voltage is less than the sum of the second previously stored voltage and the variance of the first voltage.

6. A controller programmed to:

energize a generator of an oven to raise humidity inside a chamber of the oven to a first level; and perform a simmering operation for a first predetermined amount of time after the humidity reaches the first level, the simmering operation including energizing the generator after deenergizing the generator according to a predetermined powercycle, wherein to deenergize the generator the controller is programmed to deenergize the generator until a second level of the humidity measured during the simmering operation is below a third level of the humidity, within the oven, measured during the simmering operation previous to measuring the second level.

7. A controller in accordance with claim 6, wherein the generator produces microwaves.

8. A controller programmed to:

energize a generator of an oven to raise humidity inside a chamber of the oven to a first level; and perform a simmering operation for a first predetermined amount of time after the humidity reaches the first level, the simmering operation including:

deenergizing the generator; and energizing the generator after the deenergizing of the generator; and wherein the controller programmed to perform the simmering operation comprises a microprocessor programmed to determine whether a first voltage corresponding to a humidity inside the chamber is at least equal to a sum of a second previously stored voltage corresponding to a humidity inside the chamber and a variance of the first voltage.

9. A controller in accordance with claim 8 wherein the controller programmed to deenergize comprises the microprocessor further programmed to:

deenergize the generator when the first voltage is at least equal to the sum of the second previously stored voltage and the variance of the first voltage; and deenergize the generator at end of each cycle of a second amount of time that is less than the first predetermined amount of time.

10. A controller in accordance with claim 9 wherein the controller programmed to perform the simmering operation comprises the microprocessor further programmed to determine whether the generator is deenergized for a third amount of time that is less than the second amount of time.

11. A controller in accordance with claim 10 wherein the controller programmed to energize the generator after the deenergizing comprises the microprocessor further programmed to energize the generator if the generator is deenergized for the third amount of time and the first voltage is less than the sum of the second previously stored voltage and the variance of the first voltage.

12. An oven comprising:

a generator for providing energy to an item placed inside the oven;

a sensor for sensing an amount of humidity produced by the item inside the oven; and a controller for performing a simmering operation on the item, the controller configured to:

energize the generator to raise humidity inside the oven to a first level; and perform a simmering operation for a first predetermined amount of time after the humidity reaches the first level, the simmering operation including energizing the generator after deenergizing the generator according to a predetermined powercycle, wherein to deenergize the generator the controller configured to deenergize the generator when a second level of the humidity is at least equal to a lowest level of the humidity measured during the simmering operation.

13. An oven in accordance with claim 12, wherein the generator emits microwaves.

14. An oven in accordance with claim 13, wherein the simmering operation comprises deenergizing the generator after the energizing the generator.

15. An oven in accordance with claim 12, wherein the oven is one of a microwave oven and a speedcooking oven.

16. An oven in accordance with claim 12, wherein the item is one of an item having a weight between 0.5 and 6.5 lbs., and an item having a volume between 8 oz. and 104 oz.

17. An oven comprising:

a generator for providing energy to an item placed inside the oven;

a sensor for sensing an amount of humidity produced by the item inside the oven; and a controller for performing a simmering operation on the item, the controller configured to:

energize the generator to raise humidity inside the oven to a first level; and perform a simmering operation for a first predetermined amount of time after the humidity reaches the first level, the simmering operation including:

deenergizing the generator; and energizing the generator after the deenergizing of the generator; and wherein the controller configured to perform the simmering operation comprises a microprocessor configured to determine whether a first voltage corresponding to a humidity inside the chamber is at least equal to a sum of a second previously stored voltage corresponding to a humidity inside the chamber and a variance of the first voltage.

18. An oven in accordance with claim 17 wherein the controller configured to deenergize comprises the microprocessor further configured to:

deenergize the generator when the first voltage is at least equal to the sum of the second previously stored voltage and the variance of the first voltage; and deenergize the generator at end of each cycle of a second amount of time that is less than the first predetermined amount of time.

19. An oven in accordance with claim 18 wherein the controller configured to perform the simmering operation comprises the microprocessor further configured to determine whether the generator is deenergized for a third amount of time that is less than the second amount of time.

20. An oven in accordance with claim 19 wherein the controller configured to energize the generator after the deenergizing comprises the microprocessor further configured to energize the generator if the generator is deenergized for the third amount of time and the first voltage is less than the sum of the second previously stored voltage and the variance of the first voltage.

* * * * *